United States Patent [19]

Buckenauer

[11] Patent Number: 4,674,912

[45] Date of Patent: Jun. 23, 1987

[54] ASSEMBLY FOR BRIDGING OVER EXPANSION JOINTS OR BRIDGES OR THE LIKE

[75] Inventor: Günter Buckenauer, Baldham, Fed. Rep. of Germany

[73] Assignee: Friedrich Maurer Söhne GmbH & Co. KG, Munich, Fed. Rep. of Germany

[21] Appl. No.: 643,319

[22] Filed: Aug. 22, 1984

[30] Foreign Application Priority Data

Jun. 8, 1984 [EP] European Pat. Off. ..... 84106619.4

[51] Int. Cl.[4] ..... E01C 11/14

[52] U.S. Cl. ..... 404/56; 404/63; 52/573

[58] Field of Search ..... 404/47, 53, 54, 56–60, 404/62, 63; 14/16.1, 16.5; 52/396, 573

[56] References Cited

U.S. PATENT DOCUMENTS

| | | | |
|---|---|---|---|
| 3,698,292 | 10/1972 | Koester | 404/62 X |
| 3,699,853 | 10/1972 | Wicks, III | 404/53 |
| 3,854,159 | 12/1974 | McLean et al. | 404/47 X |
| 3,907,443 | 9/1975 | McLean | 404/56 |
| 4,030,156 | 6/1977 | Raymond | 14/16.5 |
| 4,058,867 | 11/1977 | Puccio | 14/16.5 |
| 4,132,491 | 1/1979 | Scheffel | 404/56 X |
| 4,339,214 | 7/1982 | Puccio et al. | 404/57 X |
| 4,486,118 | 12/1984 | Huber et al. | 404/56 |
| 4,516,284 | 5/1985 | Huber et al. | 404/56 X |

FOREIGN PATENT DOCUMENTS 2746490 4/1979 Fed. Rep. of Germany ..... 14/16.5

*Primary Examiner*—James A. Leppink
*Assistant Examiner*—John F. Letchford
*Attorney, Agent, or Firm*—Birch, Stewart, Kolasch & Birch

[57] ABSTRACT

The arrangement for covering over a gap in a roadway has bars running across the roadway. The bars are supported by transverse beams spanning the gap obliquely and which are supported at their ends in joint gap edge structures in such a way that the ends of the beams are able to slide and swivel in relation to the edge structures. The bars are carried on the beams by friction-reducing bearing parts so that sliding of the bars is possible. The bars have openings through the structure thereof (as for example holes in the bar itself or in a frame fixed thereto) to take up the beams and the bearing parts are adapted to allow sliding without swiveling between each bearing part and the associated beam and to allow swiveling between the bearing part and a bar joined thereto. The bearings are made of elastically yielding material and each have at least one bearing body. To ensure efficient transmission of horizontal forces by the bearing bodies to the transverse beams with only a small pre-loading effect (to stop the bearing bodies being lifted clear of the transverse beams by tilting moments) the bearing bodies are shaped generally as blocks and run in respective grooves of the transverse beams.

7 Claims, 7 Drawing Figures

ASSEMBLY FOR BRIDGING OVER EXPANSION JOINTS OR BRIDGES OR THE LIKE

BACKGROUND OF THE INVENTION

The present invention relates to an arrangement for covering over the expansion joint of a bridge or the like and comprising parallel support bars running athwart the roadway of the bridge, transverse beams each swivelingly and slidingly supported at its two ends on the different sides of the expansion joint so as to span the joint at an angle to the direction of the roadway for supporting the said bars by way of a anti-friction bearing means and running through openings in the bars or in lower members attached thereto. In this respect the bearing means may be in the form of swivel-slide, elastically yielding bearings that each have at least one bearing body and which are not able to be turned in relation to the transverse beams but, slidingly joined thereto, are swivelingly joined to the bars.

In the prior art one form of cover designed on these lines for an expansion joint has been proposed in the German Pat. No. 2,746,490. In this design the bearing bodies were generally in the form of circular disks, each having a groove for one of the transverse beams to slide in relatively. There were projections next to the groove on the bars to function as guides for the sliding motion of the transverse beam. Simultaneously they functioned to transmit horizontal forces from the bar to the transverse beam.

This system for the transmission of horizontal forces from the bar to the transverse beam was beset with a number of serious shortcomings in the prior art expansion joint cover. Inasmuch as the transverse beams were placed at a slant in relation to the bars, forces were transmitted to the transverse beams which were made up both of a component in the lengthways direction of the beams as well as a force component in the transverse direction of the beam. The lengthways forces caused a placement of the bearing bodies in relation to the transverse beams, if they are in excess of the friction forces acting in the opposite direction, whereas the transverse forces were passed on by the projections on the side of the grooves to the side walls of the transverse beams. The projections placed round the transverse beams had the form of sections of a circle because of the round form of the bearing bodies, only a small area being available for the transmission of transverse forces to the transverse beams, seeing that for effective transmission of forces it is necessary for such projections to have a substantial wall thickness, such thickness however only being present in the middle part of the projections. The outcome of this is that because of the transmission of transverse forces the projections of the bearing bodies were acted upon by very large loads that were are likely to be responsible for rapid wear of the bearing bodies.

Braking or acceleration forces and the eccentric line of action of the vertical wheel load on the bars produce a tilting moment that tends to lift the bar from the bearings placed on the transverse beams. This tilting moment was to be taken up in the prior art joint cover system by using a substantial vertical pre-loading force to keep the upper and lower bearing bodies in proper engagement with the transverse beams. For its part however this large pre-loading force resulted in a large amount of friction between the bearing bodies and the transverse beams so that the slipping clutch effect, desired between the bearing bodies and the transverse beams in order to stop overloading of the bar because of braking forces only came into being when the braking forces were very large. If in the course of time there is a decrease in the pre-loading effect because of relaxation of the bearing bodies, there is then a danger that the bar will suddenly come clear of the bearing bodies when a tilting moment takes effect. This will then make such a bearing body unserviceable within a short period of time.

SHORT OUTLINE OF THE INVENTION

One aim of the present invention is to create a structure for covering over an expansion joint of the sort noted initially such that the transmission of forces and moments from the bars to the transverse beams takes place without any problems whatever the pre-loading force acting in the bearing bodies so that the same last longer and the designer may select the level of the pre-loading force only with regard to the adjustment of the slip coupling means between the bar and the transverse beam.

To effect this and other objects in the invention the bearing body is generally block-like and is guided in a groove in the transverse beam.

With such a design a very much larger area of the bearing body is available for the transmission of the transverse forces and this keeps the bearing body from being damaged thereby. A further point is that the bearing body placed in a groove in the transverse beam and guided therein, is automatically more or less completely secured against tilting so that only a very low vertical pre-loading force is needed to be certain that the bearings are not able to lose their proper engagement with the transverse beams. The fact that the pre-loading force is only a minor one means that there is only a small amount of friction between the bearing bodies and the transverse beams so that sliding motion of the bearing bodies is possible in the grooves of the transverse beams even when the horizontal forces are at a low level. The bearing bodies not only have a considerably longer working life which reduces repair and upkeep work thereon to a minimum, but furthermore the production of the bearing bodies is greatly simplified also.

To make it possible for the bars to be supported on the transverse beams without any chance of rocking or tilting whatsoever, it is best for each sliding and swiveling bearing to comprise one bearing body placed under the transverse beam and one placed thereover. The vertical pre-loading force on the elastic bearing bodies is preferably so selected that on a certain maximum braking force being exceeded there will be no further increase in the force acting on the bar because the bar is shifted on transverse beams against the friction forces that are dependent on the vertical pre-loading of the bearing bodies.

Preferably the bearing body is made of an elastomer and it is armed on its sliding surface and on the opposite face with a plate of abrasion-resistant anti-friction material. This plate is preferably made of steel and it has an anti-friction material thereon.

A further useful effect is possible if the plate on the surface opposite to the anti-friction material layer of the bearing body has a round blind hole therein, in which a round disk-like guide pin is fitted which is mounted on a plate welded to the bar.

In the case of a preferred working example of the invention the bearing bodies have such a length that there is still a gap between the bars when they are moved towards each other as far as they will go, whereas the bearing bodies of each transverse beam will then have their end faces in contact with each other. This makes certain that when traffic drives over the bars no noise is produced by the bars knocking against each other. The minimum gap between the bars is preferably 5 mm broad.

It is best for all the transverse beams to be joined with all the bars by slide and swivel bearings.

Preferably the possible shifting motion of the transverse beams is limited by means of stops placed in the edges of the joint so that it is not possible for the beams to slide out past the edges of the joint. It is then possible to have further slide and swivel bearings in pockets in the joint edges to support the ends of the transverse beams.

As part of a preferred form of the invention at least three transverse beams are present that are oblique in relation to the bars and to each other, each such beam sloping in the opposite direction to the beam or beams next to it.

Further features and merits of the invention will be seen from the following account of one preferred working example thereof using the drawings.

LIST OF DIFFERENT VIEWS OF THE DRAWINGS

DETAILED ACCOUNT OF WORKING EXAMPLE OF THE INVENTION

Figure 1:
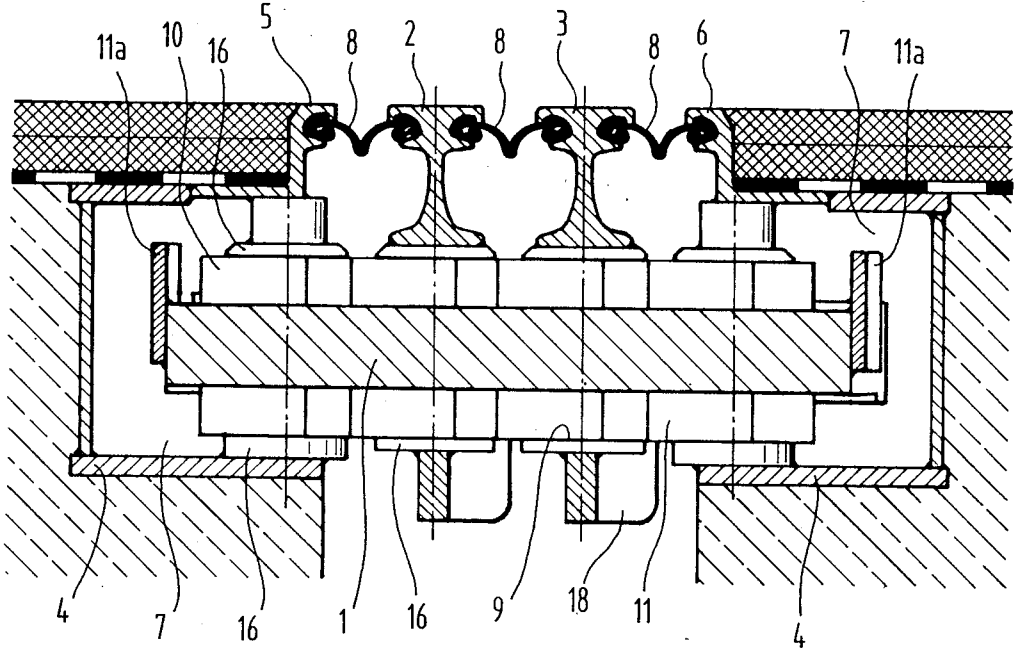
FIG. 1 is a vertical section through a bridging over or covering device for an expansion joint in keeping with the invention, the plane of the section being across the joint and through one of the transverse beams from end to end.

In FIG. 1 the reader will see a transverse beam 1 sectioned form end to end in the plane of the figure and having two bars 2 and 3 supported thereon. At the edges of the joint there are joint edge structures 4 each comprising one edge bar 5 and 6 respectively. The two ends of the transverse beam 1 are each taken up in a hollow 7 in one of the respective edge structures 4.

In the gaps between the bars there are in each case sealing bodies 8 made of rubber-like or rubber sections that still make it possible for the bars to be pushed together. The bars 2 and 3 may have openings in them or, as in the present case, openings 9 delimited by U-like frames 18 fixed under them, through which the transverse beams 1 are placed. The bars 2 and 3 are supported by way of slide swivel bearings on the transverse beams 1, such bearings each being made up of an upper bearing body 10 and a lower bearing body 11. The bearing bodies 10 and 11 generally have the form of a block or parallelepiped. At the ends of the transverse beams there are stops 11*a* to limit shifting motion of the transverse beams in both directions.

Figure 2:
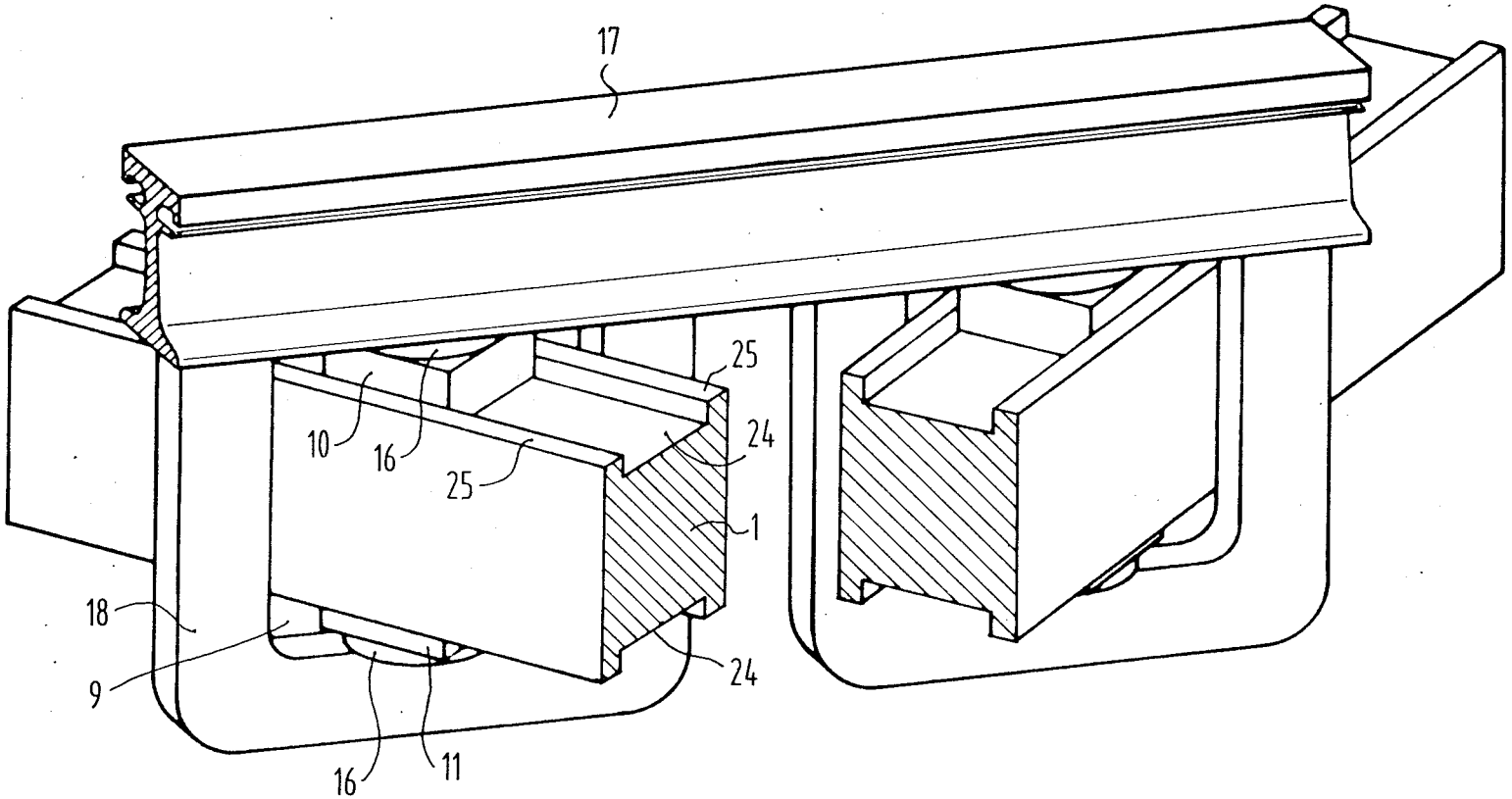
FIG. 2 is a perspective view of two slide and swivel bearings on the lower side of a bar.
Figure 3:
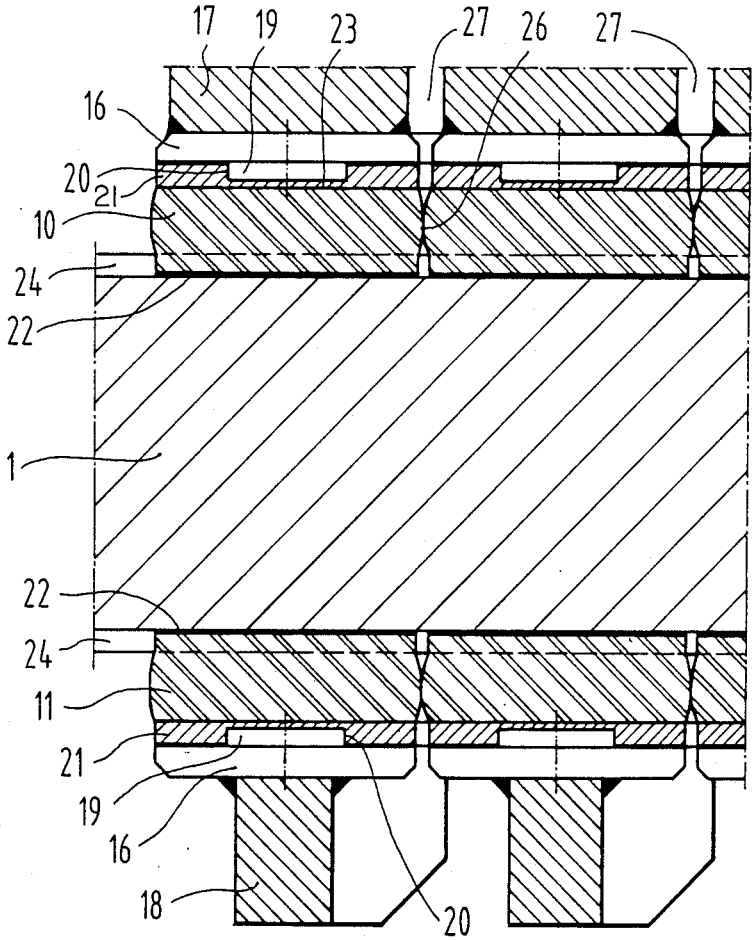
FIG. 3 is vertical section to show a detail with the bars moved together.

Further details of the bearing bodies will be able to be seen from the FIGS. 2 and 3. The slide and swivel bearing in these FIGS. 2 and 3 is placed in the said U-like frame 18 placed on the lower side of bar 17. The legs of the frame 18 are fixed to the lower face of the bar 17 by welding. On the lower side of the bar 17 a plate 16 with a guide pin 19 thereon is welded. The guide pin 19 is fitted into a round blind hole 20 in a steel plate 21 on the surface 23 of the bearing body 10 opposite to the sliding face 22.

The lower bearing body 11 is fixed in the same way on the U-like frame 18, there being a plate 16 welded to the U-like frame. This plate 16 has a guide pin 19, which fits into the round blind hole 20 in the steel plate 21.

The bearing bodies 10 and 11 are placed in grooves 24 formed in the top and lower sides of the transverse beam 1. In these grooves the bearing bodies are guided by the side walls 25, that also function for the transmission of horizontal forces from the bar 17 to the transverse beam 1.

Figure 4:
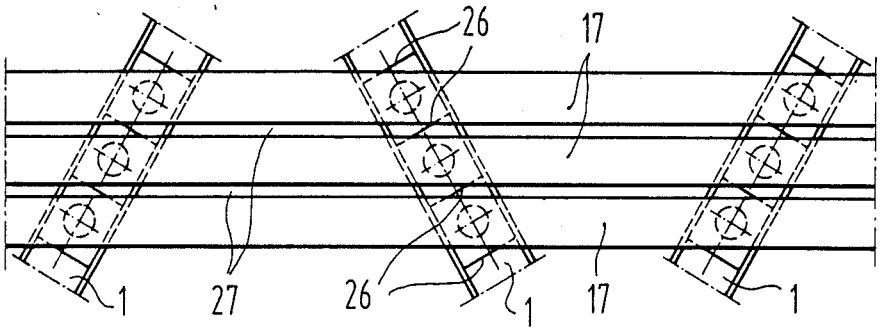
FIG. 4 is a diagrammatic view of the bridging over device with the width of the joint at a minimum.

FIGS. 3 and 4 show the bridging over device with a minimum opening out of the expansion joint. In this condition the bearing bodies 10 and 11 of the different transverse beams 1 are placed with their end faces 26 up against each other. There is then a minimum gap 27 between each bar and the next bar, such gap having a size of about 5 mm. This design makes certain that the bars are not knocked together when acted upon by horizontal forces, such knocking otherwise causing undesired noise.

Figure 5:
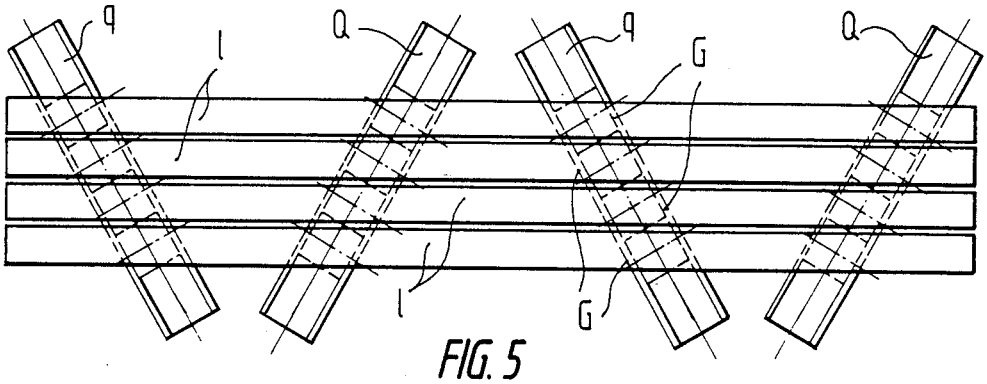
FIGS. 5 to 7 are each diagrammatic plan views of the bridging over device for expansion joints with the joint width at the minimum, medium and maximum size respectively.
Figure 6:
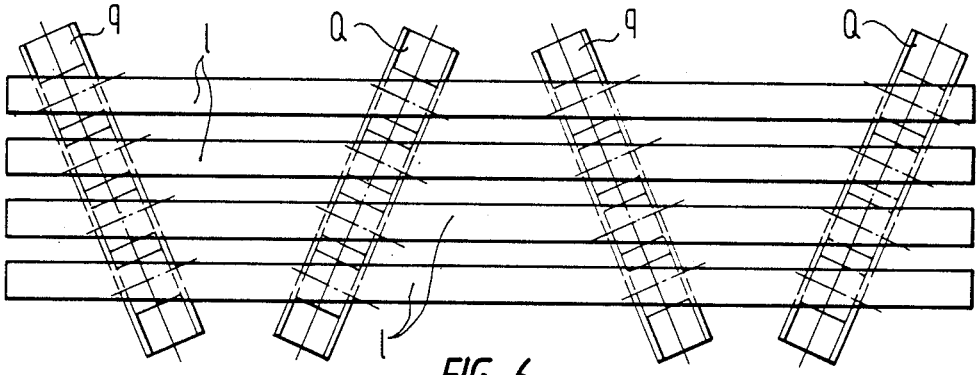
Figure 7:
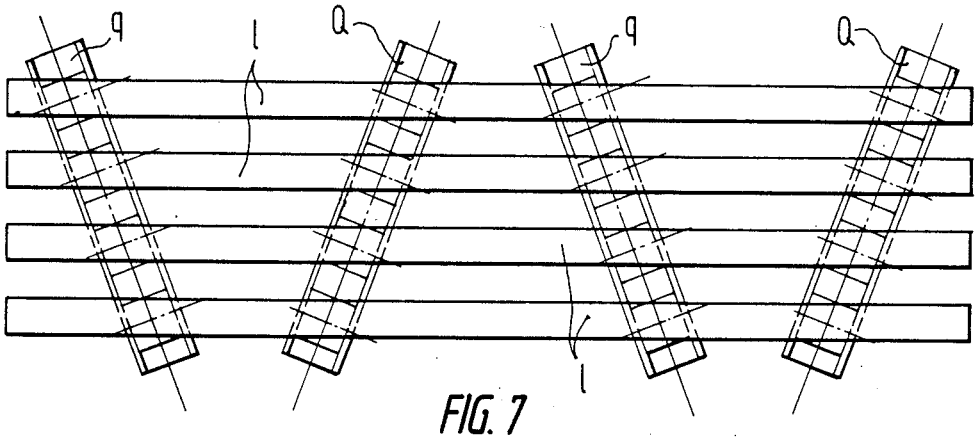

FIGS. 5 to 7 are different plan views of a bridging over device as a diagram of only the positions of the transverse beams and bars. The bars 1, of which there are in all four, are mounted on four transverse beams Q and q. The transverse beams are slanted in alternate directions in relation to the bars, i.e. so that each of beams is at an oblique angle opposite to the beam or beams next to it with two beams sloping to the right and two to the left. Each of the transverse beams is joined with each of the bars by way of a sliding bearing G to be seen in FIGS. 1 to 3. Because the pivot points of the sliding bearings are fixed in relation to the bars, a change in the breadth of the joint gap width will necessarily be accompanied by swiveling and translation of the transverse beams Q in relation to the bars 1, that are always parallel to each other. In FIG. 6 the bridging over device will be seen with a medium joint gap size, the transverse beams being at about 45° to the transverse beams Q. FIG. 7 on the other hand shows the position of the parts when the joint gap is maximum and equal to about 80 mm, the distances between the bars are larger and the angle between one bar and the next is smaller.

In FIG. 5 the reader will see the smallest size of gap with the bearing bodies resting against each other. The angle formed between one transverse beam Q and its neighbor q is larger than the angle between the beams in the medium gap position of FIG. 6. As a consequence of the sliding and swivel connection there is necessarily an even spacing of the bars at every size of the joint gap. The gap between one bar and the next and the gap between moving bars and the stationary bars are of equal size in this respect, although play in the means for moving the bars will cause irregularities.

I claim:

1. A device for covering over an expansion joint in a roadway having a lengthways axis comprising parallel support bar structues running athwart the axis of the roadway, transverse beams each swivelingly and slidingly supported at its two ends on different sides of the expansion joint so as to bridge over the joint at an angle to the said axis of the roadway for supporting the said bars, said support bar structures each having an opening through which one of said transverse beams extends, connection means between each said bar and each said transverse beam including an upper sliding bearing between said bar structure and said transverse beam, and a lower sliding bearing between said bar structure and the bottom side of said transverse beam, said connection means allowing tilting about a vertical axis and transmitting vertical and horizontal bearing forces, said upper sliding bearing and said lower sliding bearing each including bearing bodies designed for transmitting shearing forces and each having at least one pair of parallel sides, said transverse beams being each provided with a groove having lateral walls on the upper side and a groove having lateral walls on the lower side as part of said connection means, said groove walls on said upper side contacting said parallel sides of said upper sliding bearing and said groove walls on said lower side contacting said parallel sides of said lower sliding bearing, each said bearing having a metal plate fixed thereto and located between said bar structure and each said bearing body in shear-resistant connection with said bearing body, said metal plate transmitting contact forces occurring between said bearing body and said lateral walls of said groove.

2. The device as claimed in claim 1 wherein such plate is a steel plate surfaced with an anti-friction covering.

3. The device as claimed in claim 1 wherein said metal plate has a round blind hole therein, said bar adjacent to said metal plate having a second plate welded thereon with a pin on said second plate fitting into said blind hole.

4. The device as claimed in claim 1 where the length of each said bearing body is such that when said expansion joint is at its minimum width end faces of said bearing bodies are in contact with each other and the bars are still spaced by each other by small gaps.

5. The device as claimed in claim 4 wherein said small gaps are 5 mm in width.

6. The device as claimed in claim 1 having joint edge structures fitted with further slide and swivel bearings for supporting ends of the transverse beams.

7. The device as claimed in claim 1 wherein at least three such transverse beams are placed obliquely in relation to each other and to the bars in such a way that each such beams is oblique in the opposite direction to such a beam next to it in alternating succession.

* * * * *